US007341493B2

(12) United States Patent
Pepe et al.

(10) Patent No.: US 7,341,493 B2
(45) Date of Patent: Mar. 11, 2008

(54) ELECTRICAL CONNECTOR HAVING STAGGERED CONTACTS

(75) Inventors: Paul John Pepe, Clemmon, NC (US); Linda Ellen Bert, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/435,644

(22) Filed: May 17, 2006

(65) Prior Publication Data

US 2007/0270043 A1 Nov. 22, 2007

(51) Int. Cl.
*H01R 24/00* (2006.01)

(52) U.S. Cl. ..... 439/676; 439/941

(58) Field of Classification Search ..... 439/676, 439/941, 344

See application file for complete search history.

(56) References Cited

U.S. PATENT DOCUMENTS 6,120,329 A * 9/2000 Steinman ..... 439/676
6,328,609 B1 * 12/2001 Ezawa et al. ..... 439/676
6,350,158 B1 2/2002 Arnett et al.
6,558,207 B1 * 5/2003 Pepe et al. ..... 439/862
6,869,318 B2 * 3/2005 Viklund et al. ..... 439/676
6,932,655 B2 8/2005 Hatterscheid et al.
7,186,149 B2 * 3/2007 Hashim ..... 439/676
2005/0136747 A1 6/2005 Caveney et al.

FOREIGN PATENT DOCUMENTS

EP 1 347 539 9/2003

* cited by examiner

*Primary Examiner*—Michael C Zarroli

(57) ABSTRACT

An electrical connector includes a dielectric housing having a mating end and a cavity extending from the mating end. The cavity is configured to receive a mating connector through the mating end. The electrical connector also includes a contact sub-assembly having an array of contacts. The contact sub-assembly is received in the housing such that each of the contacts are exposed within the cavity to engage the mating connector. Each of the contacts have a beam portion and a tail portion, and each tail portion includes a base section joined to a leg at a bend. The legs extend downward from the mating interfaces in a staggered pattern to form first and second sets of legs aligned in different first and second planes.

20 Claims, 5 Drawing Sheets

ELECTRICAL CONNECTOR HAVING STAGGERED CONTACTS

BACKGROUND OF THE INVENTION

This invention relates generally to electrical connectors, and more specifically, to electrical connectors having contacts arranged in a staggered pattern.

Due to increases in data transmission rates in telecommunications systems, crosstalk has become a significant problem. Crosstalk may be defined as energy which is coupled from one signal line onto a nearby signal line by either capacitive or inductive coupling. This crosstalk results in signal noise which interferes with the purity of the signal being transmitted.

A commonly used telecommunications wiring system is twisted pair wiring wherein pairs of wires are twisted about each other. The wires in a twisted pair carry differential signals and are thus known as signal pairs. Each of the wires in a signal pair carries an equal but opposite signal; that is, the wires carry signals of the same magnitude which are respectively positive and negative. Since these signals are equal but opposite, they generate fields that are equal but opposite. In a twisted pair these equal and opposite fields cancel each other. Thus, minimal crosstalk can occur between one twisted pair and a nearby twisted pair.

Crosstalk in twisted pair wiring systems primarily arises in the electrical connectors which provide an interface between successive runs of cable in a system or an interface with equipment. One source of the crosstalk is the interface between modular plugs and jacks in the telecommunications system. These connectors have terminals or contacts which are spaced closely together and parallel to each other, and this close and parallel arrangement is conducive to crosstalk between nearby lines in different ones of the signal pairs. Further, the terminals in a modular plug are dedicated to specific ones of the twisted wires according to a known industry standard such as Electronics Industries Alliance/Telecommunications Industry Association ("EIA/TIA")-568. Therefore, ends of the wires must be arranged in a closely spaced parallel sequence in the plug, and these parallel ends are also conducive to crosstalk.

Since crosstalk increases logarithmically as the frequency of the signal increases, the constant trend toward higher data transmission rates has resulted in a need for crosstalk reduction. For example, crosstalk which occurs in a modular jack of a communications cable rises significantly at very high frequencies on the order of 250-500 MHz. Prior art techniques for reducing crosstalk have focused primarily on the modular jacks and on the circuit boards of the modular jacks. For example, the circuit boards provide compensation by routing traces in a predetermined pattern to compensate for the crosstalk between the terminals. However, a delay exists between the source of the crosstalk and the compensation for the crosstalk due to the distance between the mating interface and the circuit board. As such, a need exists for a connector that provides compensation for crosstalk at or near the source of the crosstalk (e.g. the mating plug) and minimizes the creation of additional crosstalk within the jack contacts, thus reducing the overall crosstalk of the connector and increasing the electrical performance of the connector.

BRIEF DESCRIPTION OF THE INVENTION

In one aspect, an electrical connector is provided including a dielectric housing having a mating end and a cavity extending from the mating end. The cavity is configured to receive a mating connector through the mating end. The electrical connector also includes a contact sub-assembly having an array of contacts. The contact sub-assembly is received in the housing such that each of the contacts are exposed within the cavity to engage the mating connector. Each of the contacts have a beam portion and a tail portion, and each tail portion includes a base section joined to a leg at a bend. The legs extend downward from the mating interfaces in a staggered pattern to form first and second sets of legs aligned in different first and second planes.

At least some embodiments may include contacts having the legs in the first set of legs aligned with one another and the legs in the second set of legs aligned with one another. Each tail portion may include a tip section joined to the leg proximate an end of the contact, wherein each of the tip sections joined to the legs in the first set of legs are aligned with one another and each of the tip sections joined to the legs in the second set of legs are aligned with one another. Optionally, the first set of legs may be off-set toward the mating end of the housing with respect to the second set of legs such that the mating connector simultaneously engages the mating interfaces of the contacts having the legs in the first set of legs prior to simultaneously engaging the mating interfaces of the contacts having the legs in the second set of legs. The legs may be inclined vertically downward toward a base of the contact sub-assembly.

In another aspect, an electrical connector is provided having a contact sub-assembly base having a contact supporting surface, and an array of contacts mounted to the contact sub-assembly base and arranged along the contact supporting surface. The contacts are configured to engage a mating connector, and each of the contacts having a beam portion and a tail portion. Adjacent tail portions are off-set with respect to one another to form a first row of contacts and a second row of contacts.

DETAILED DESCRIPTION OF THE INVENTION

Figure 1:
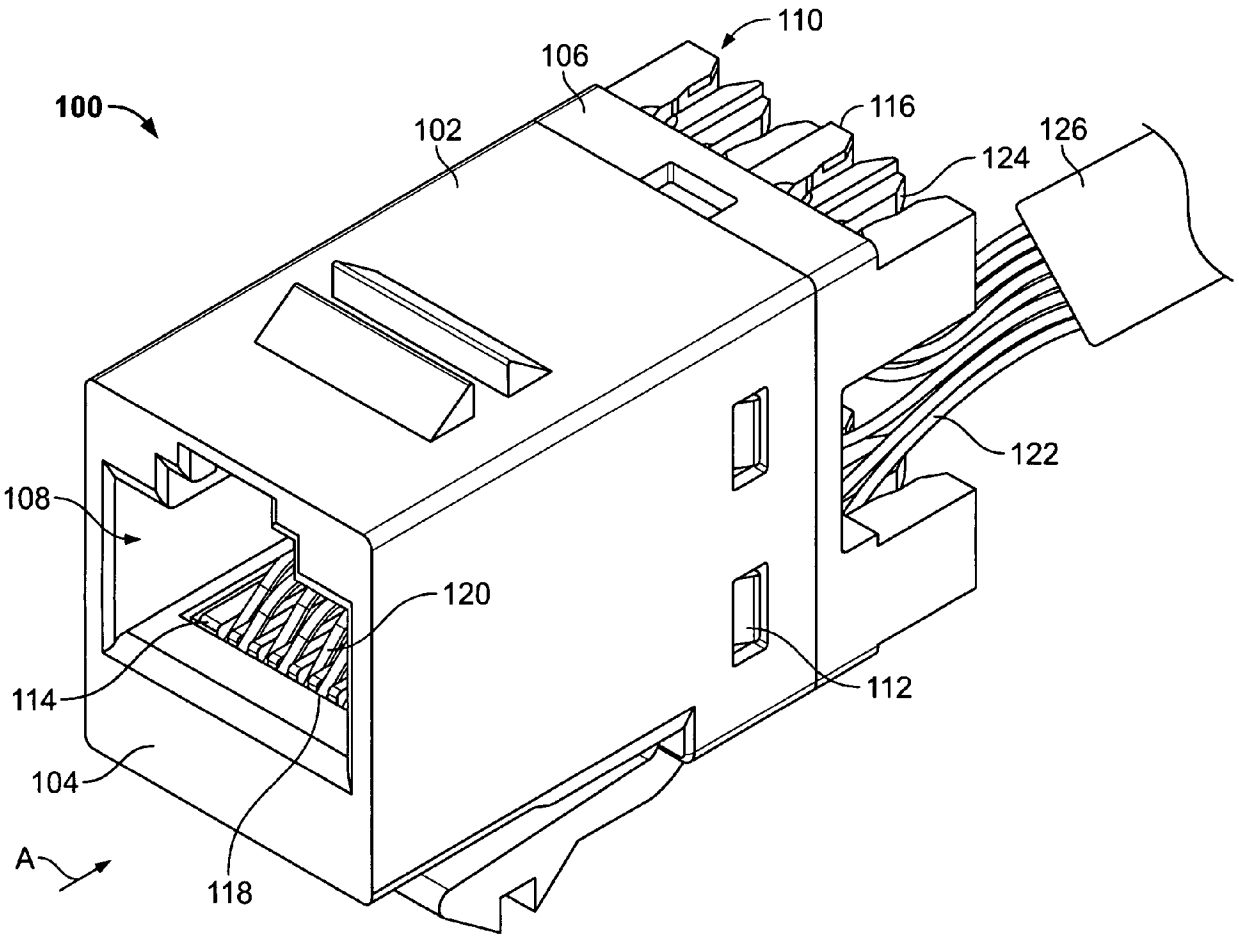
FIG. 1 illustrates a front perspective view of an exemplary electrical connector.

FIG. 1 illustrates a front perspective view of an exemplary electrical connector 100. In the illustrated embodiment, the connector 100 is a modular 8-pin connector, such as an RJ-45 outlet or jack. The connector 100 is configured for joining with a mating plug (not shown). The mating plug is loaded along a mating direction, shown generally by arrow A. The connector 100 includes a housing 102 having a mating end 104 and a loading end 106. A cavity 108 extends between the mating end 104 and the loading end 106. The cavity 108 receives the mating plug through the mating end 104.

The connector 100 includes a contact sub-assembly 110 received within the housing 102 through the loading end 106 of the housing 102. The contact sub-assembly 110 is secured to the housing 102 via tabs 112. The contact sub-assembly 110 extends between a mating end 114 and a wire terminating end 116 and is held within the housing 102 such that the mating end 114 of the contact sub-assembly 110 is positioned proximate the mating end 104 of the housing 102. The wire terminating end 116 extends outward or rearward from the loading end 106 of the housing 102. The contact sub-assembly 110 includes an array of pins or contacts 118. Each contact 118 includes a mating interface 120 arranged within the cavity 108 to interface with corresponding pins or contacts (not shown) of the mating plug when the mating plug is joined with the connector 100. The arrangement of the contacts 118 may be controlled by industry standards, such as the EIA/TIA 568. In an exemplary embodiment, the connector 100 includes eight contacts 118 arranged as differential pairs.

A plurality of communication wires 122 are attached to terminating portions 124 of the contact sub-assembly 110. The terminating portions 124 are located at the wire terminating end 116 of the contact sub-assembly 110. The wires 122 extend from a cable 126 and are terminated to terminating portions 124. Optionally, the terminating portions 124 may include insulation displacement connections (IDCs) for terminating the wires 122 to the contact sub-assembly 110. Alternatively, the wires 122 may be terminated to the contact sub-assembly 110 via a soldered connection, a crimped connection, and the like. In an exemplary embodiment, the connector 100 includes eight wires 122 arranged as differential pairs. Optionally, each wire 122 is electrically connected to a corresponding one of the contacts 118. For example, a signal transmitted along each wire 122 may be routed through the connector 100 to the corresponding contact 118.

Figure 2:
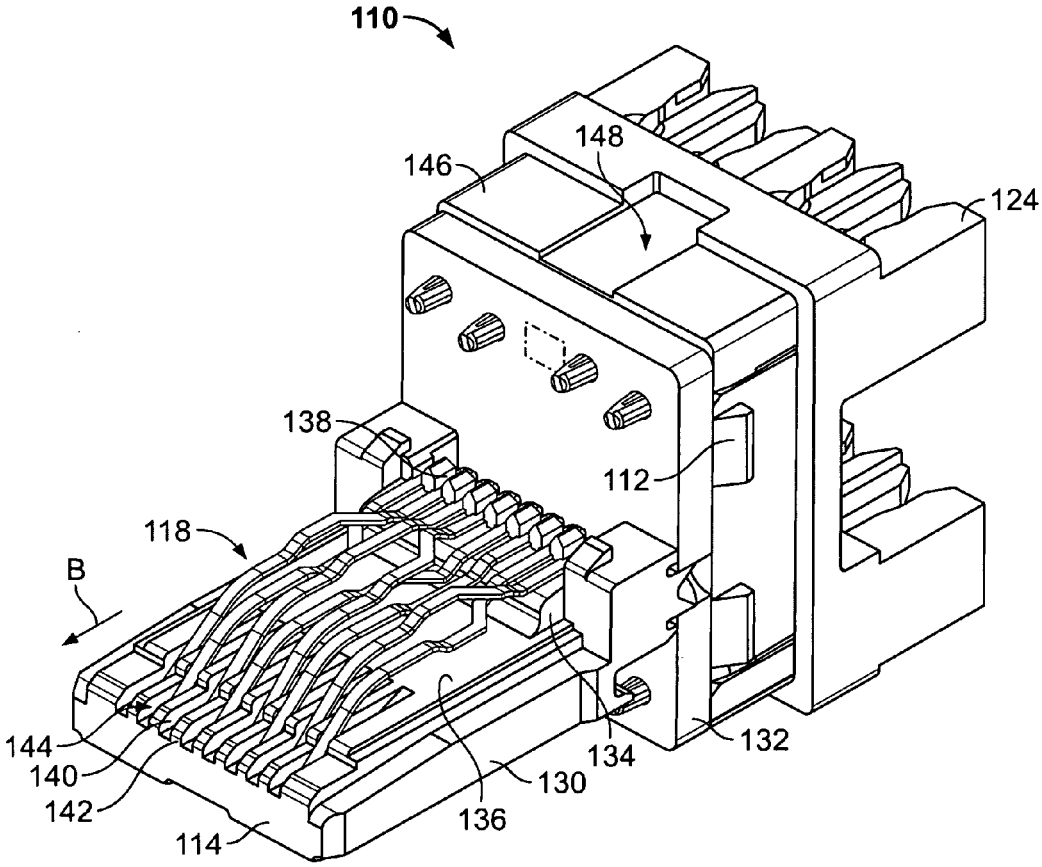
FIG. 2 illustrates a front perspective view of an exemplary contact sub-assembly for the electrical connector shown in FIG. 1.

FIG. 2 illustrates a front perspective view of the contact sub-assembly 110. The contact sub-assembly 110 includes a base 130 extending rearward from the mating end 114 to a circuit board 132. The base 130 supports the array of contacts 118, which are aligned along the base 130. Additionally, the contacts 118 extend in a direction that is generally parallel to the loading direction of the mating plug (shown in FIG. 1 by arrow A). Optionally, the base 130 may include a supporting block 134 positioned proximate to the circuit board 132. The supporting block 134 is elevated from a top surface 136 of the base 130 and includes a plurality of guide members 138 that orient and align the contacts 118 for mating to the circuit board 132.

A plurality of channels 140 are recessed in the base 130. Each channel 140 receives a corresponding one of the contacts 118. The channels 140 are elongated and allow the contacts 118 to slide within the channels 140. For example, during mating with the mating plug, the contacts 118 may be depressed toward the base 130 to provide clearance for the mating connector within the cavity 108 (shown in FIG. 1). As the contacts 118 are depressed, the portion of the contacts 118 within the channels 140 are moved generally forward in the direction of the mating end 114, such as in the direction of arrow B. Each channel 140 has a bottom 142 generally opposed from an open top 144. The bottoms 142 operate as contact supporting surfaces. Optionally, the bottom 142 of each channel 140 is aligned along a common horizontal plane. Alternatively, the bottoms 142 may be off-set on multiple horizontal planes. For example, adjacent channels 140 may be in different planes. Optionally, the bottoms 142 may be sloped or inclined toward the mating end 114 such that the plane is inclined with respect to the base 130. Alternatively, the contacts 118 may be directly supported by the top surface 136 of the base 130. In another alternative embodiment, the contacts 118 may be connected to another circuit board located along the top surface 136 of the base 130.

The contact sub-assembly 110 also includes a terminating portion body 146 extending rearward from the circuit board 132 to the terminating portions 124. The terminating portion body 146 is sized to substantially fill the rear portion of the cavity 108 (shown in FIG. 1). Optionally, the terminating portion body 146 may include a groove 148 for receiving a portion of the housing 102 during assembly.

Figure 3:
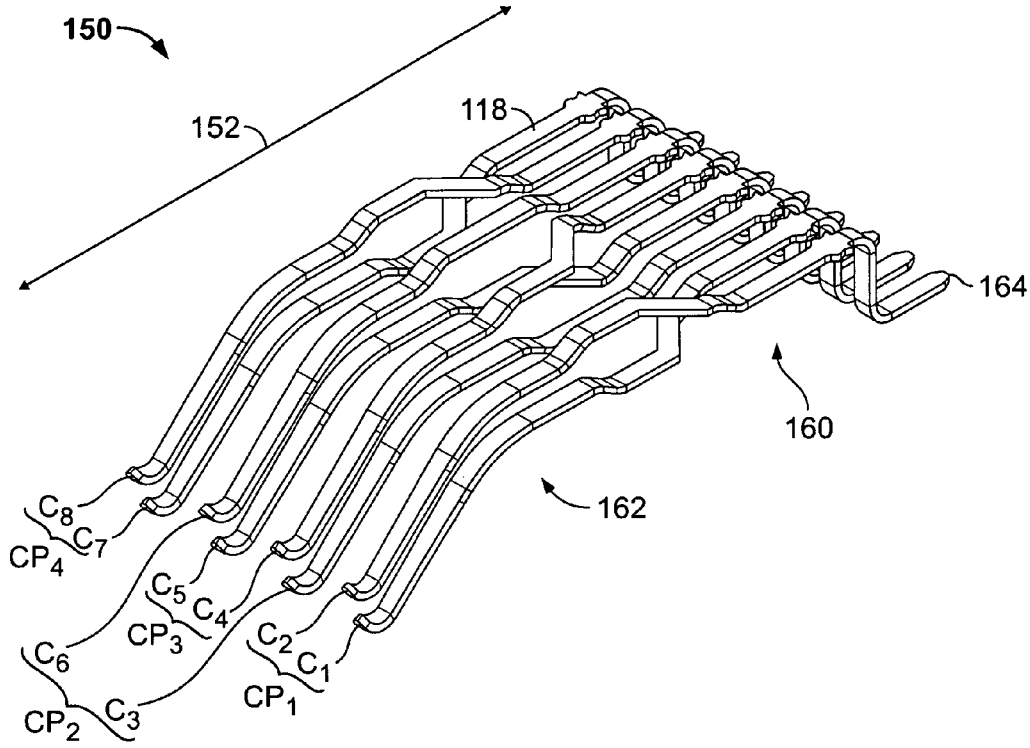
FIG. 3 illustrates a front perspective view of an exemplary contact array of the contact sub-assembly shown in FIG. 2.

An exemplary contact array 150 having a plurality of contacts 118 is described with reference to FIGS. 3-5. FIG. 3 illustrates a front perspective view of the exemplary contact array 150. In the illustrated embodiment, the contact array 150 includes eight contacts 118 identified as $C_1$-$C_8$. The contacts 118 are arranged as differential contact pairs identified as $CP_1$-$CP_4$. Each contact pair $CP_1$-$CP_4$ conveys a differential signal. Nearby contacts 118 may negatively interact with each other (e.g. create crosstalk) to decrease the signal performance of the connector 100 (shown in FIG. 1) when mated to the mating plug (not shown). The interaction may be affected by the spacing, sizing and/or positioning of the contacts 118 with respect to nearby contacts. In the illustrated embodiment, contact pair $CP_1$ includes contacts $C_1$ and $C_2$. Contact pair $CP_2$ includes contacts $C_3$ and $C_6$. $CP_3$ includes contacts $C_4$ and $C_5$. Contact pair $CP_4$ includes contacts $C_7$ and $C_8$. However, the contact array 150 is provided as one exemplary embodiment, and it is realized that the contact array 150 may include more or less than eight contacts 118, and the contacts 118 may have other configurations.

Each contact 118 extends generally along a contact axis 152 that extends in a direction generally from the mating end 104 (shown in FIG. 1) to the terminating end 106 (shown in FIG. 1) of the connector 100. Each contact 118 includes a beam portion 160 and a tail portion 162 joined to one another. Optionally, the beam portion and the tail portion are unitarily formed. The beam portion 160 extends from a termination end 164 that is terminated to the circuit board 132 (shown in FIG. 2). Alternatively, the termination end 164 is directly terminated to a corresponding one of the wires 122 (shown in FIG. 1). The beam portions 160 are generally parallel to one another and extend generally in the loading direction of the mating plug (shown in FIG. 1 by arrow A) toward the terminating end 106.

Figure 4:
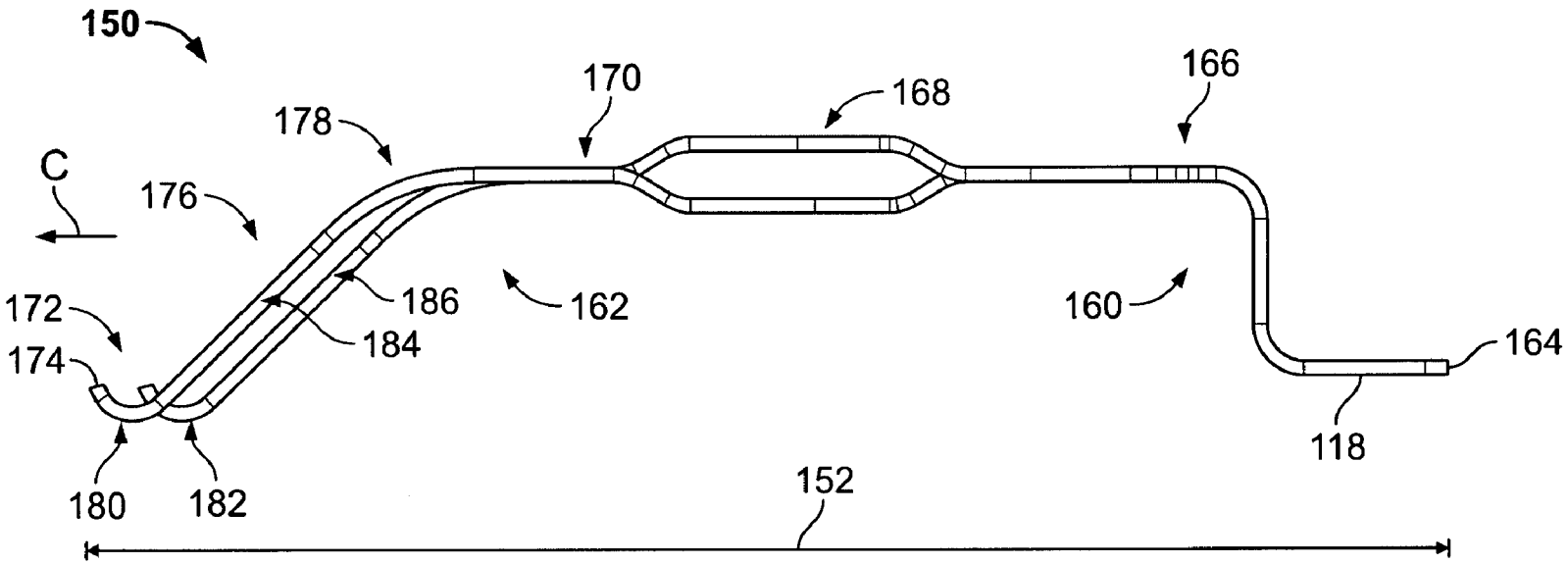
FIG. 4 illustrates a side view of the contact array shown in FIG. 3.

FIG. 4 illustrates a side view of the contact array 150. As illustrated in FIG. 4, each beam portion 160 includes a transition section 166 extending upstream from the termination end 164. Optionally, a portion of the transition section 166 may extend vertically, such as in a direction generally perpendicular to the contact axis 152, to change the elevation of the contact 118 with respect to the base 130 (shown in FIG. 2) of the contact sub-assembly 110 (shown in FIG. 2). Optionally, as illustrated in FIG. 3, each of the transition sections 166 are aligned side by side with one another. Each of the terminating ends 164 are thus aligned and engage the circuit board 132 (shown in FIG. 2) in a planar arrangement. Alternatively, the transition sections 166 may be sized differently such that the terminating ends 164 engage the circuit board 132 in a non-planar arrangement.

Figure 5:
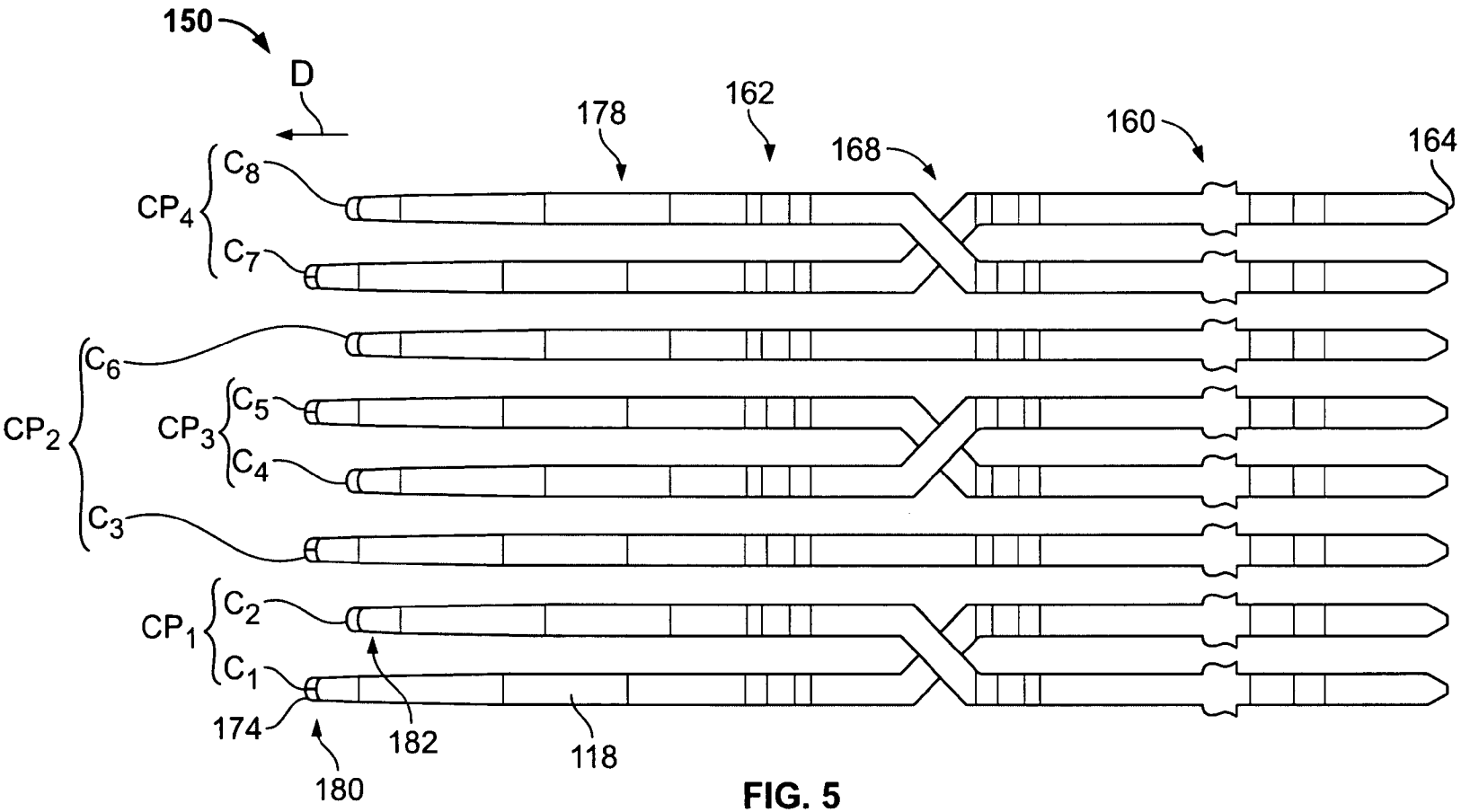
FIG. 5 illustrates a top view of the contact array shown in FIG. 3.

FIG. 5 illustrates a top view of the contact array 150 with the contacts 118 arranged in a predetermined pattern. The beam portions 160 have the terminating ends 164 arranged in a first predetermined order, and the tail portions 162 are arranged in a second predetermined order. In the illustrated embodiment, the first and second orders are different, however, the orders may be the same in alternative embodiments. The position of a particular contact 118 with respect to each of the other contacts 118 may be changed by a cross-over section 168 of the contact 118. For example, the cross-over section 168 may change the position of a contact 118 from an outer-most positioned contact to an inner positioned contact, or vice versa.

In the illustrated embodiment, the contacts 118 in contact pairs $CP_1$, $CP_3$ and $CP_4$ have cross-over sections 168. The ordering of the beam portions 160 and terminating ends 164 downstream of the cross-over sections 168 are switched with respect to the ordering of the tail portions 162 upstream of the cross-over sections 168. By changing the ordering of the beam portions 160 of the contacts 118, the interactions between the contacts 118 are altered and crosstalk of the electrical connector 100 may be reduced. Optionally, the cross-over sections 168 change both a horizontal positioning and a vertical positioning of the contacts 118 within the electrical connector 100. For example, as best illustrated in FIG. 4, one of the contacts 118 may be vertically raised by the cross-over section 168 and one of the contacts 118 may be vertically lowered by the cross-over section 168. As best illustrated in FIG. 5, one of the contacts 118 may be shifted horizontally inward toward a center of the contact array 150 and one of the contacts 118 may be shifted horizontally outward away from the center of the contact array 150. Optionally, the cross-over section 168 forms part of the beam portion 160, and the tail portion 162 joins the beam portion 160 immediately upstream of the cross-over section 168.

Returning to FIG. 4, each tail portion 162 includes a base section 170 extending upstream from the beam portion 160, a tip section 172 extending downstream of a tip 174 of the contact 118, and an intermediate section or leg 176 extending between the base section 170 and the tip section 172. The base section 170 includes a bend or curved portion defining a mating interface 178. The mating interface 178 is positioned to engage the mating plug (not shown) with the electrical connector 100. The bend provides a surface for interfacing with corresponding pins or contacts (not shown) of the mating plug. The mating interface 178 is positioned at an upstream end of the base section 170 and meets the leg 176. Optionally, the legs 176 are non-orthogonally oriented with respect to the base sections 170. For example, the legs 176 may be inclined or angled generally downward from the elevated position of the base section 170 generally toward the base 130 (shown in FIG. 2) of the contact sub-assembly 110. The tip sections 172 are radiused and positioned to engage the base 130. Optionally, the tip sections 172 of each of the contacts 118 are aligned along a single horizontal plane. Alternatively, the tip sections 172 may be arranged on multiple horizontal planes.

The array of contacts 118 are arranged with respect to the contact sub-assembly 110 such that the tail portions 162 are staggered or off-set with respect to one another to form a first row of contacts 180 and a second row of contacts 182. The legs 176 of the first row of contacts 180 are each aligned with one another along a common first plane and define a first set of legs 184. The legs 176 of the second row of contacts 182 are each aligned with one another along a common second plane and define a second set of legs 186. The first and second planes are substantially parallel to one another and offset with respect to one another. The first and second planes are inclined with respect to the horizontally extending contact axis 152.

As illustrated in FIGS. 4 and 5, each of the tips 174 of the contacts 118 in the first row of contacts 180 are aligned with one another and each of the contacts 118 in the second row of contacts 182 are aligned with one another. However, the contacts 118 in the first row of contacts 180 are positioned forward of the contacts 118 in the second row of contacts 182, such as in the direction of arrow C shown in FIG. 4 or arrow D shown in FIG. 5. As such, during mating of the electrical connector 100 with the mating plug, the mating plug simultaneously engages each of the contacts 118 of the first row of contacts 180 at the mating interfaces 178 prior to simultaneously engaging each of the contacts 118 at the mating interfaces 178 in the second row of contacts 182. Alternatively, the contacts 118 may be arranged in more than two rows of contacts.

In the illustrated embodiment, each adjacent contact 118 is in a different one of the rows of contacts. For example, contacts $C_1$, $C_3$, $C_5$ and $C_7$ are included in the first row of contacts 180. Contacts $C_2$, $C_4$, $C_6$ and $C_8$ are included in the second row of contacts 182. As such, within a given contact pair $CP_1$-$CP_4$, one of the contacts (e.g. the odd numbered contact) is arranged in the first row of contacts 180 and the other of the contacts (e.g. the even number contact) is arranged in the second row of contacts 182. As a result, the crosstalk between the contacts 118 within a given contact pair is reduced as the contacts 118 within that contact pair are staggered or offset with one another. Additionally, positive interactions between the contacts 118 may be created between the contacts 118 within each of the rows of contact 180 and 182. The positive interactions may reduce the effects of crosstalk and may increase the electrical performance of the connector 100.

A connector 100 is thus provided having a unique contact array 150 arrangement that provides a reduction in crosstalk. As a result, the electrical performance of the connector 100 is increased. The contacts 118 in the contact array 150 include tail portions 162 that are staggered from the mating end 104 of the connector 100. The contacts 118 are staggered into two rows of parallel contacts 118, wherein each of the even numbered contacts are in one row and each of the odd numbered contacts are in a different row. By staggering the contacts 118, the contact array 150 isolates certain contacts 118 from one another to reduce crosstalk between those particular contacts (e.g. $C_2$ and $C_3$) By staggering the contacts 118, the contact array 150 increases interactions between other of the contacts 118 to allow those contacts to positively interact with one another (e.g. $C_1$ and $C_3$). As a result, the overall crosstalk of the connector 100 is decreased and the overall performance electrical performance of the connector 100 is increased. Moreover, the compensation is provided at or near the mating interface 178 which may be a large source of crosstalk.

While the invention has been described in terms of various specific embodiments, those skilled in the art will recognize that the invention can be practiced with modification within the spirit and scope of the claims.

What is claimed is:

1. An electrical connector, comprising:

a dielectric housing having a cavity configured to receive a mating connector therein;

a contact sub-assembly having an array of contacts, the contact sub-assembly received in the housing such that each of the contacts are exposed within the cavity to engage the mating connector, each of the contacts having a beam portion and a tail portion, each tail portion includes a base section joined to a leg at a bend, the legs extending downward from the bends to a distal end of the contacts, the legs of the tail portions at least partially define a mating interface configured to interface with the mating connector, and the tail sections being positioned such that the legs are arranged in a staggered pattern to form a first set of legs and a second set of legs, wherein the mating interface of the legs in the first set of legs being arranged substantially parallel to, and off-set from, the mating interface of the legs in the second set of legs.

2. The electrical connector of claim 1, wherein each of the first set of legs and the second set of legs includes legs from more than two contacts.

3. The electrical connector of claim 1, wherein the legs in the first set of legs are aligned with one another and the legs in the second set of legs are aligned with one another.

4. The electrical connector of claim 1, wherein each tail portion includes a tip section joined to the leg proximate the distal end of the contact, each of the tip sections joined to the legs in the first set of legs being aligned with one another and each of the tip sections joined to the legs in the second set of legs being aligned with one another.

5. The electrical connector of claim 1, each of the base sections joined to the legs in the first set of legs being longer than each of the base sections joined to the legs in the second set of legs such that the first set of legs are arranged closer to a mating end of the housing than the legs of the second set of legs.

6. The electrical connector of claim 1, wherein the first set of legs are off-set toward a mating end of the housing with respect to the second set of legs such that the mating connector simultaneously engages mating interfaces of the contacts having the legs in the first set of legs prior to simultaneously engaging mating interfaces of the contacts having the legs in the second set of legs.

7. The electrical connector of claim 1, wherein each of the contacts extend along a contact axis being substantially parallel to a loading direction of the mating connector.

8. The electrical connector of claim 1, wherein the beam portions are arranged substantially parallel to one another.

9. The electrical connector of claim 1, wherein the beam portions of at least some of the contacts include a cross-over section wherein the ordering of the tail portions upstream of the cross-over sections is different than the ordering of the beam portions downstream of the cross-over sections.

10. The electrical connector of claim 1, wherein the legs are non-orthogonal with respect to the base sections.

11. The electrical connector of claim 1, wherein the legs are inclined vertically downward toward a base of the contact sub-assembly.

12. The electrical connector of claim 1, wherein the contact sub-assembly further includes a base having an exposed surface exposed to the cavity of the housing, and wherein each tail portion includes a tip section proximate the distal end of the contact, each of the tip sections engaging the exposed surface along a plane.

13. The electrical connector of claim 1, wherein the contact sub-assembly further includes a base having an exposed surface exposed to the cavity of the housing, and wherein each tail portion includes a tip section joined to the leg of the tail portion, the tip sections joined to the legs in the first set of legs engaging the exposed surface along a first plane and the tip sections joined to the legs in the second set of legs engaging the exposed surface along a second plane.

14. The electrical connector of claim 1, wherein the contacts convey differential signals, a first of the contacts conveying one of the differential signals having the leg in the first set of legs and a second of the contacts conveying the same differential signal having the leg in the second set of legs.

15. An electrical connector, comprising:

a dielectric housing having a cavity configured to receive a mating connector therein;

a contact sub-assembly having an array of contacts, the contact sub-assembly received in the housing such that each of the contacts are exposed within the cavity to engage the mating connector, each of the contacts having a beam portion and a tail portion, each tail portion includes a base section joined to a leg at a bend, each tail portion includes a tip section at a distal end thereof, the legs extending downward from the bends in a staggered pattern to form first and second sets of legs aligned in different first and second planes, wherein the contact sub-assembly further includes a base having an exposed surface exposed to the cavity of the housing, the base having a plurality of channels extending from the exposed surface, the tip sections of the tail portions received within respective ones of the channels and slidable within the channels.

16. The electrical connector of claim 15, wherein each of the first set of legs and the second set of legs includes legs from more than two contacts.

17. An electrical connector, comprising:

a contact sub-assembly base having a at least one contact supporting surface generally facing in a common direction and configured to be exposed to a mating connector; and an array of contacts mounted to the contact sub-assembly base and arranged along the contact supporting surface, the contacts configured to engage the mating connector, each of the contacts having a beam portion and a tail portion, each tail portion having a tip section at a distal end thereof, wherein adjacent tail portions are offset with respect to one another to form a first row of contacts and a second row of contacts, the tip sections of the contacts in the first row of contacts rest upon a respective one of the at least one contact support surface and generally extend therefrom along a first plane and the tip sections of the contacts in the second row of contacts rest upon a respective one of the at least one contact support surface and generally extend therefrom along a second plane.

18. The electrical connector of claim 17, wherein the contacts convey differential signals, a first of the contacts conveying one of the differential signals being arranged in the first row of contacts and a second of the contacts conveying the same differential signal being arranged in the second row of contacts.

19. The electrical connector of claim 17, wherein the contacts in the first row of contacts are aligned with one another and the contacts in the second row of contacts are aligned with one another.

20. The electrical connector of claim 17, wherein the first row of contacts are offset toward a mating end of the housing with respect to the second row of contacts such that the mating connector simultaneously engages the contacts of the first row of contacts prior to simultaneously engaging the contacts of the second row of contacts.

* * * * *